United States Patent [19]

Rutherford

[11] 3,991,536

[45] Nov. 16, 1976

[54] LATHING

[76] Inventor: Barry A. Rutherford, 10008 Forbes Ave., Sepulveda, Calif. 91343

[22] Filed: Mar. 31, 1975

[21] Appl. No.: 563,383

[52] U.S. Cl. ..... 52/661; 52/664; 52/741

[51] Int. Cl.[2] ..... E04C 2/42

[58] Field of Search ..... 52/342, 343, 344, 357, 52/361, 362, 363, 454, 351, 660, 676, 661, 741; 245/8; 85/1 JP, 50 R

[56] References Cited

UNITED STATES PATENTS

| | | | |
|---|---|---|---|
| 1,712,125 | 5/1929 | Voight | 52/676 |
| 1,826,499 | 10/1931 | Blackburn | 52/343 |

FOREIGN PATENTS OR APPLICATIONS

| | | | |
|---|---|---|---|
| 692,740 | 8/1964 | Canada | 52/342 |
| 682,415 | 3/1964 | Canada | 85/1 JP |

*Primary Examiner*—Price C. Faw, Jr.
*Assistant Examiner*—Carl D. Friedman
*Attorney, Agent, or Firm*—Christie, Parker & Hale

[57] ABSTRACT

Improved welded wire fabric lath including a double strand of wire located at predetermined spaced intervals. The wires of the double strand are spaced slightly apart to provide a slot for receiving fasteners used to hold the lath in place on wood and metal framing. In a self furring embodiment of the lathing according to the present invention, the double strand is located along the interval corresponding to the crimping or ribs provided to space or fur the lathing from the framing. Self threading fasteners of a modified design for use with the lathing also comprise a part of the present invention.

17 Claims, 8 Drawing Figures

LATHING

DESCRIPTION OF THE PRIOR ART

The present invention relates to lathing and in particular to self furring lathing of a wire mesh type having crimps or ribs located at spaced intervals to partially space the lathing material from the framing members to which the lathing material is to be attached.

The lathing to which the present invention relates has found wide application particularly in multistory building construction, providing a metal base for plastering intended for both interior and exterior applications. In the prior art, such lathing is provided in various configurations but comprises basically a wire mesh of intersecting horizontal and vertical welded wires defining a plurality of rectangular openings typically of a 1½ inches by 2 inches mesh.

Interwoven with the mesh is a sheet of absorbent paper having rows of oblong slots, the longitudinal slot axis coinciding with the horizontal strands in the mesh and extending transversely of the long axis of the rectangles of the mesh. In certain applications such lathing material has waterproofed backing paper adhesively secured to the interwoven paper layer. Lathing of this latter type is used in both interior and exterior applications where a waterproofed lathing is a requirement. Particularly with the waterproofed lathing product, a horizontal furring crimp is provided at spaced intervals to add a self furring feature to the lathing.

In use, prior art lathing is attached to wood and metal framing members by means of a number of different fasteners, including self-tapping screws, nails, clips, hog rings, and tie-ons. When installed with self-tapping screws, typically screws with a hexagonal head are used. In order to provide satisfactory support for the lathing material the screws were provided with washers and were located such that the head overlapped the intersection of a horizontal and vertical strand and the horizontal strand rested on the shank of the screw. Such a limitation constrained the positioning of fasteners to locations where such intersections overlapped studding, leading to non-uniform spacing. In addition, considerable difficulty was encountered in the physical manipulation steps of mounting the screws while at the same time holding the lathing in place and insuring that the screw head and washer satisfactorily overlapped the wire intersection so that adequate support for the lathing was provided. Nails were also used, but to provide adequate support and prevent the wire from slipping out from underneath the head, typically they were driven halfway home and then bent over the horizontal strand.

Once installed, the lathing was limited to a certain holding strength. In addition, because of non-uniform spacing of the fasteners, the lathing was subject to bagging and bulging once the lathing was installed. When waterproofing was specified, the screw fasteners were provided with neoprene washers. Whether conventional washers or neoprene washers were used, their cost was essentially equal to the cost of the fastener alone.

SUMMARY OF THE INVENTION

The present invention relates to an improvement of the lathing material just described, lathing which comprises a plurality of spaced-apart, parallel intersecting vertical and horizontal strands secured together at the point of intersection such that the strands define a screen of predetermined mesh dimension. In lathing material of this type the invention provides an improvement comprising an additional strand located adjacent and spaced a small distance from certain of the lathing strands such that the pairs of closely spaced strands define a plurality of parallel slots extending across the lathing material for receiving fastening members driven into framing material for supporting the lathing. The fasteners have a head dimension of a size sufficient to bridge the wire slots.

The advantages of the improved lathing of the present invention relative to the prior art are significant and numerous. Because the spaced apart double strands of wire define fastener receiving slots which extend continuously across the material it is now possible to locate the fasteners at any point along the length and width of the lathing material. The fasteners can be passed through the lathing at any point along the slot defined by the double strands and can be uniformly spaced in both horizontal and vertical directions.

Among other significant advantages of the present invention is the dramatic decrease in installation time, since the necessity to overlap and pin wire intersections to the framing is eliminated and manipulation of lathing and fasteners is greatly simplified.

The substantial reduction in installation time is due to the fact that the double strand of wire acts as a guide or threading for the fasteners which essentially prevents the screw fasteners from wandering as the operator attaches the fasteners to the strand of the lath into the frame of the material. By use of the fasteners which are a part of the present invention, having an enlarged head, an overlap of both strands of the double strands by the head of the fasteners is insured without the necessity of providing washers.

Other advantages flowing from the present invention include a substantial increase in holding strength by virtue of the mounting of the lathing by means of the plurality of spaced apart slots defined throughout the material, elimination of the tendency of the material to bag or bulge since in the present invention a completely uniform pattern of fasteners distributed throughout the lathing is obtained.

By providing lathing material having slots at spaced intervals, screw fasteners or nails can now be used at all locations over the surface to be lathed, eliminating the use of clips, hog rings or tie-ons in order to mount the lathing and providing a substantial reduction in the material cost per foot of mounted lathing. This in turn means that the perforations and holes through the waterproofed backing paper due to clips, rings, etc., is eliminated, thereby insuring the integrity of the waterproofing provided by the backing paper. Where waterproofing is required in the present invention, an improved neoprene washer is provided.

In addition, since the lathing is now eminently suited for use with screw fasteners or nails alone, the use of washers is eliminated, resulting in further savings in terms of material costs.

DESCRIPTION OF THE DRAWINGS

These and other advantages of the present invention will be better understood by reference to the figures of the drawing, wherein.

DESCRIPTION OF A SPECIFIC EMBODIMENT

Figure 1:
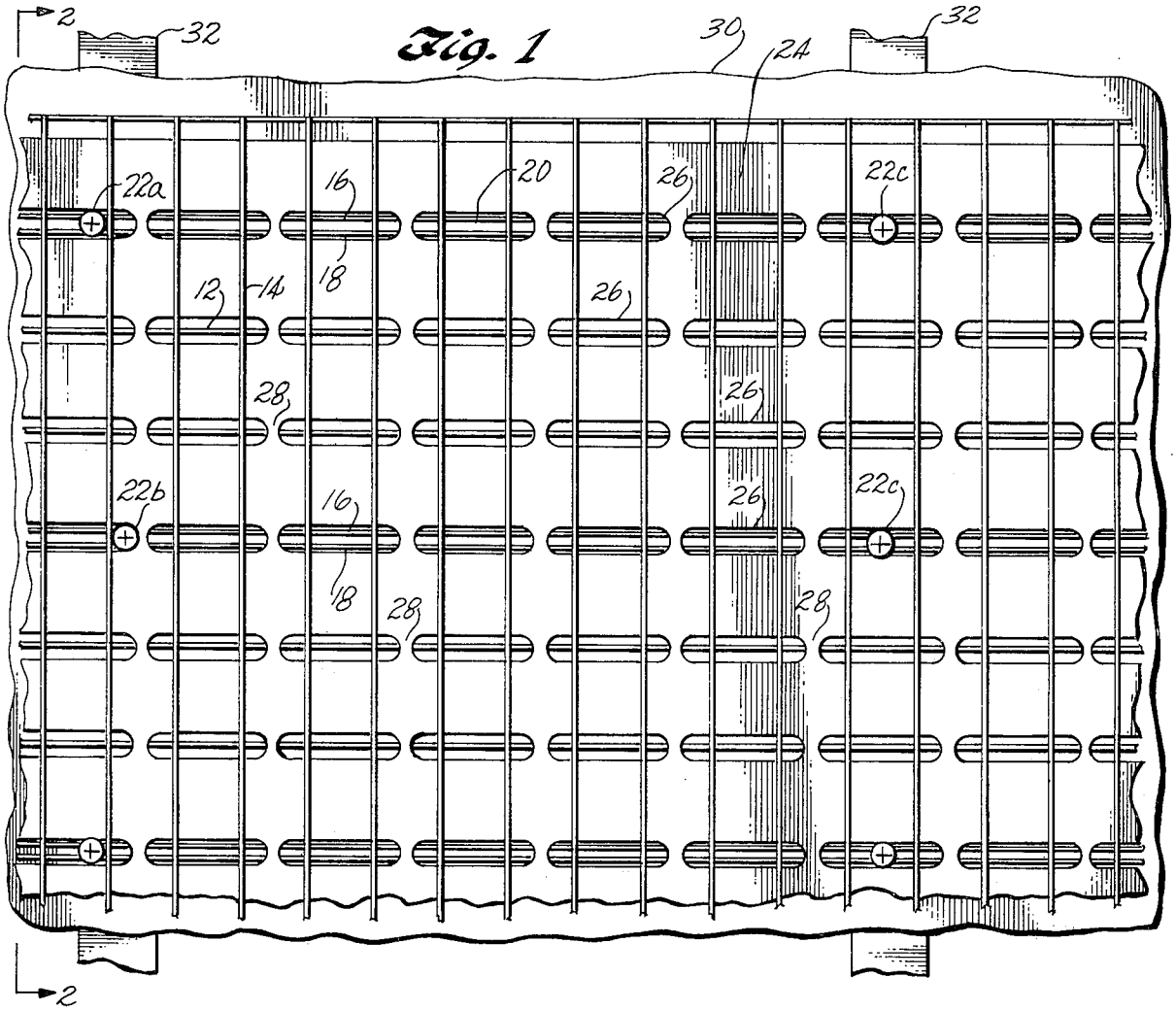
FIG. 1 is a front view of the lathing material according to the present invention attached to framing studs with fasteners which also form a facet of the invention.
Figure 3:
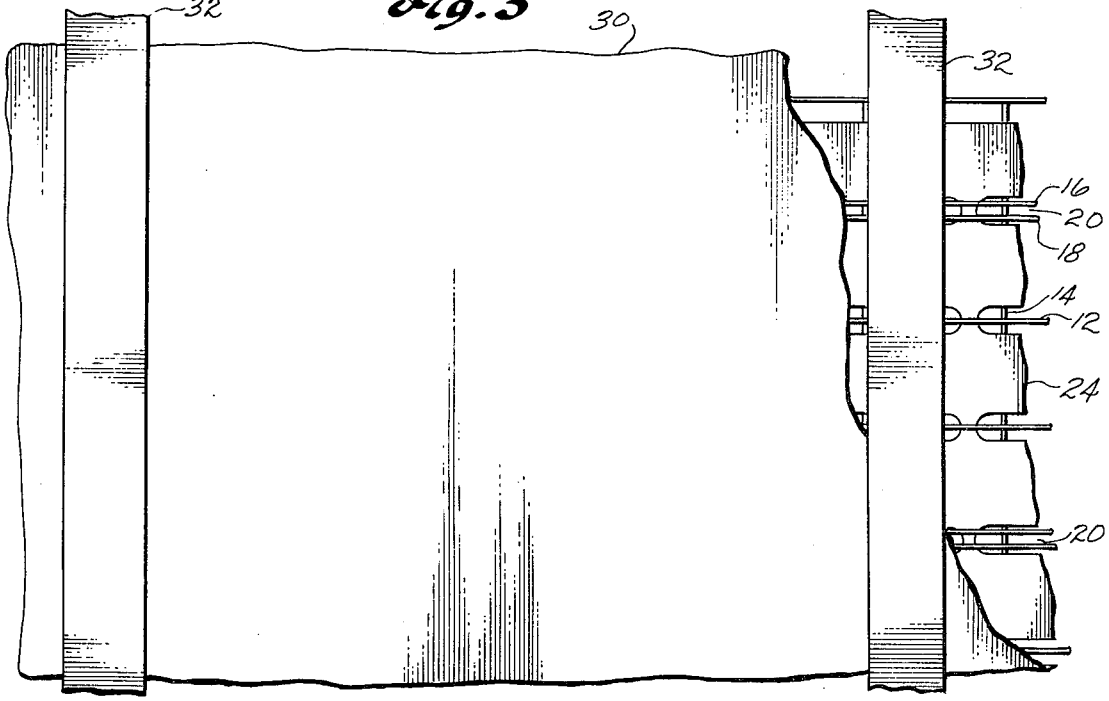
FIG. 3 is a rear elevation with a portion of the waterproof backing paper partially broken away.

Referring now to FIGS. 1 and 3, lathing 10 shown therein includes a plurality of spaced apart horizontal strands 12 and spaced apart vertical strands 14 which intersect at right angles with respect to each other and are spot-welded at each point of intersection. At spaced intervals horizontally, a pair of strands or wire 16, 18 replace the single strands 12. Strands 16, 18 are spaced apart a predetermined distance, typically one quarter of an inch, to define a continuous horizontal slot extending across the width of the sheet of lathing for receiving fasteners 22.

Figure 2:
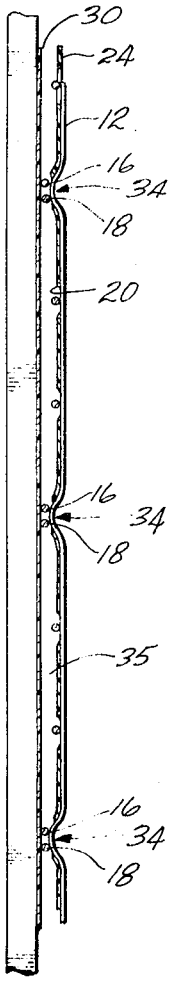
FIG. 2 is a side elevational view of the lathing material shown in FIG. 1.

In the embodiment of FIGS. 1, 2, and 3, the double strand 16, 18 is provided at every third horizontal interval. This pattern is carried throughout the height of the sheet of lathing. In lathing sheets of different sizes and weights repetitions of the double strand-slot configuration are varied to provide the desired holding strength and prevent bagging and bulging of the lathing. The present invention is applicable to lathing of various mesh dimensions.

Interwoven with the wire mesh defined by the horizontal and vertical strands is a sheet of absorbent paper 24 having a plurality of oblong slots 26 extending horizontally across the sheet coaxial with each horizontal single and double strand of wire. In general, sheet 24 underlies the vertical strands 14 and is essentially coplanar with the horizontal strands 12 which underlie the vertical strands. Relatively thin tongues 28 of paper which bridge the longitudinal ends of adjacent pairs of slots overlie the horizontal strands. Underlying sheet 24 is a second waterproof sheet 30 which adhesively secured to sheet 24 on the side opposite the wire mesh. Lathing according to the present invention is provided in sheets of conventional size, typically approximately 2 1½2′ × 4′ and 2 1½2′ × 8′.

Framing studs 32 provide vertical suppots upon which lathing according to the present invention is mounted. In mounting the lathing prior to plastering, the sheet is lifted into position on the studs and fasteners 22 are driven through the slots 20 defined by the double horizontal strands. As shown, the fastener can be driven through the lathing at any point along its horizontal extent, since the double strand slot provides a receptacle into which the fastener is threaded, guiding it into its secured position on the studs.

As seen in FIG. 1, fastener 22*a* is located to the left of a vertical strand, whereas fastener 22*b* is located to the right of the same strand. At another location, fasteners 22*c* are located midway between two vertical strands and are driven through the center of the stud with which they are associated. An important advantage of the present invention is thus illustrated. By providing a continuous slot, the fasteners no longer need to be located such that they overlap the point of intersection between a vertical and a horizontal strand of wire so that the head in effect "pins" the intersection to the stud. As can be readily seen, mounting the fasteners in this way requires manual dexterity and facility and entails additional time in placing, holding and driving the fasteners to be sure that the point of intersection is pinned underneath the head of the fastener. As can be seen from FIG. 1, instances occur when the points of intersection of horizontal and vertical strands lie essentially along the exterior edges of one or more studs, making it difficult, if not impossible, to attach a fastener at that point. Omission of a fastener along a line of studding has the disadvantageous effect of allowing the lathing to bag and bulge for lack of support at each and every stud in the construction.

A side elevational view of the lathing of FIGS. 1 and 3 is shown in FIG. 2. In this figure, the crimping or ribbing of the vertical strands is shown at 34. As can be seen from FIG. 2, the location of crimping corresponds to the location of the double horizontal strands 16, 18 of wire to provide the slot for receiving fasteners which is an important aspect of the present invention.

As can further be seen from FIG. 2, the waterproof backing sheet 30 bears against the studs. Due primarily to the crimping, the absorbent sheet 24 is spaced at predetermined distance from the waterproof backing sheet as are the single horizontal and vertical strands of the lathing mesh 10. The space 35 between the waterproof backing sheet 30 and absorbent sheet 24 is the area wherein plastering applied over the surface of the wire mesh can spread through slots 20 to provide a satisfactory key whereby the plaster is securely held by the lathing.

Figure 4A:
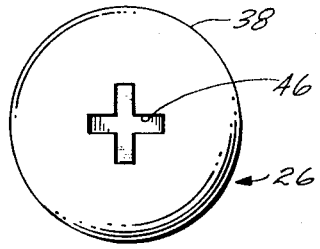
FIGS. 4A and 4B are top and side elevation views respectively of a first type of fastener according to the present invention.
Figure 4B:
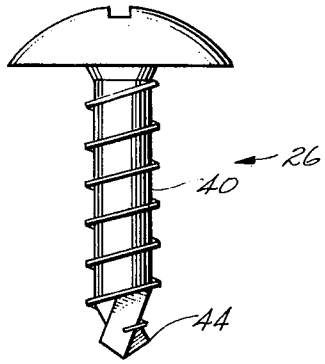

Two embodiments of fasteners for use with lathing of the present invention are also contemplated. The first embodiment is shown in FIGS. 4A and 4B. The fastener 36 shown therein comprises a round head 38 and a threaded shank 40. The shank 40 is provided with a self-threading tip 44, frequently referred to as a "Tek" tip. A crossed slot 46 for receipt of a Phillips head screwdriver is located in head 38. By providing slots such as slots 20 of FIG. 3, the necessity of providing washers as in the prior art is eliminated. The fastener 36 of this embodiment is used on heavier gauge stud material, such as 16 through 20 gauge studs and is self-threading and self-cutting under the drive of a power screwdriver mounting tool.

Figure 5A:
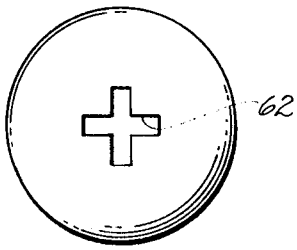
FIGS. 5A and 5B are top and side elevation views respectively of an alternate type of fasteners according to the present invention.
Figure 5B:
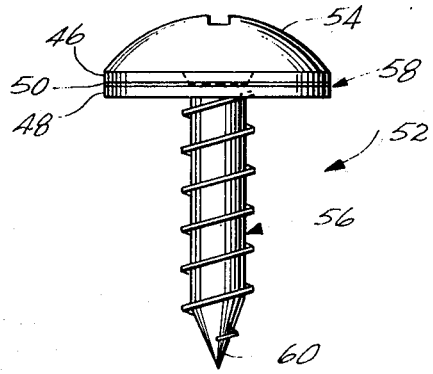

An alternate embodiment of the fastener of FIGS. 4A and $B is shown in FIGS. 5A and 5B. This embodiment is for use with lighter gauge studs such as 25 gauge stud material and is frequently referred to in the trade as an "A" tip fastener. This fastener 52 comprises a head 54, a threaded shank 56, an improved neoprene washer 58, and a pointed tip 60 at the end of the shank and illustrates a fastener used in an application calling for waterproofing. A Phillips head slot 62 is likewise provided in head 54 of this fastener. Washer 58 comprises a pair of neoprene discs 46, 48 bracketing a layer of cloth 50. The function of the two neoprene discs is to provide a high friction point of contact on the wire strand and under the head of the fastener when the fastener is seated on the two horizontal strands defining the spaced apar slots of the lathing of the present invention. The use of neoprene provides waterproofing as in the prior art. The layer of fabric 50 sandwiched between the discs acts as a binder to prevent the neoprene disc 48 from tearing as it seats on the wire strands. The upper disc 46 replaces a metal washer of the prior art and provides significantly improved frictional contact with the fastener head, preventing the fastener from being turned down too far.

Figure 6:
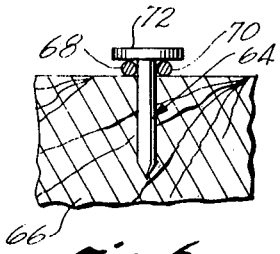
FIG. 6 is a cross-sectional view of a nail type fastener pinning lathing strands to a framing member.

In FIG. 6 an alternate embodiment of another fastener used in the present invention is illustrated. In this embodiment the fastener is a nail 64. As shown, the nail is driven home into a framing member such as a wooden stud 66 pinning a closely-spaced pair of horizontal strands 68, 70 which define the fastener receiving slot of the present invention to the framing member. The diameter of head 72 of the nail 64, as is the case with the diameter of heads 38, 54 of the threaded fasteners in FIGS. 4 and 5, is of a dimension such that it is at least as large as and preferably in excess of the dimension measured from exterior edge to exterior edge of the strands defining the slot. Fasteners of this configuration assure that the pairs of strands defining the slot are pinned to the framing member without the necessity of providing washers as in the prior art to enlarge the effective diametrical dimension of the fastener head. This results in a lathing material which combines lath of a predetermined mesh dimension having a plurality of slots extending thereacross and fasteners having enlarged heads in which the necessity of washers is eliminated except in those instances where the building specifications call for waterproofing at the point where the fasteners are attached to framing members.

What is claimed is:

1. In a lathing material comprising a plurality of spaced apart intersecting vertical and horizontal strands secured together at the points of intersection such that the strands define a grid in which the spaces between strands are larger than the head diameter of conventional fasteners, the improvement comprising:

an additional strand closely spaced adjacent and arranged in parallelism with each of a certian of the strands such that the pairs of closely spaced strands define a plurality of slots located at spaced intervals across the lathing material for receiving fasteners to be driven into framing members on which the lathing is mounted.

2. Lathing material according to claim 1 wherein the additional strand is horizontally disposed when the lathing material is mounted.

3. Lathing material according to claim 2 wherein the additional horizontal strand is secured to the vertical strands at each point of intersection with the vertical strands.

4. Lathing material according to claim 2 wherein the additional strand is provided at every second horizontal strand.

5. Lathing material according to claim 2 wherein the additional horizontal strand is provided at every third horizontal strand interval.

6. Lathing material according to claim 1 wherein the additional strand is spaced a distance from the adjacent strand such that the slot defined therebetween is sufficiently wide to receive and guide the shank of the fastener into the framing members on which the lathing is to be mounted and the adjacent strands are spaced sufficiently close to seat beneath and be covered by the head of the fastener.

7. Lathing material according to claim 1 wherein the additional strand is spaced a distance from the adjacent strand such that the slot defined therebetween is sufficiently wide to receive and guide a threaded fastener in a threaded engagement as it is driven into the framing member on which the lathing is to be mounted and the adjacent strands are spaced sufficiently close to seat beneath and be covered by the head of the threaded fastener.

8. Lathing material according to claim 1 wherein the lathing is crimped at spaced intervals to space a portion of the lathing material away from the framing members to provide a key for plaster mounted on said lathing.

9. Lathing material according to claim 8 wherein the plurality of slots are located at the same intervals at which the lathing material is crimped.

10. Lathing material for mounting plaster and the like comprising a plurality of spaced-apart, intersecting vertical and horizontal strands secured together at the point of intersection such that the strands define a screen of a at least a one inch by one inch mesh dimension;

an additional strand closely spaced adjacent and arranged in parallel with certain of the horizontal strands to define a plurality of slots located at predetermined spaced intervals extending across the lathing material; and fasteners passing into the slots defined by the double horizontal strands of wire and driven into the framing members to support the lathing material, the fasteners having an enlarged head such that the head diameter is at least as large as the transverse dimension measured across the slots from the exterior sides of the strands defining the slot.

11. Lathing material according to claim 10 including a washer provided with each fastener, the washer comprising a pair of neoprene discs secured to and spaced apart by an inner layer, the washer being adapted to seat over the hole in the framing material caused by the fastener to prevent the leakage of moisture therein.

12. Lathing material according to claim 11 wherein each fastener is threaded and is provided with a rounded head and a Phillips head slot.

13. Lathing material according to claim 11 wherein each fastener is a nail with an enlarged flat head.

14. The method of attaching lathing material to framing comprising the steps of

1. fabricating a sheet of lathing material by securing a grid of relatively widely-spaced horizontal and vertical wires at their points of intersection,

2. positioning and securing a plurality of auxiliary wires in closely spaced parallel relation to a selected number of horizontal wires to define fastener slots, the width of the slots being selected such that each is approximately equal to the diameter of the shank of a fastener to be used in mounting the lathing material, and

3. securing the lathing material to framing by driving a selected number of fasteners through the fastener slots and into the framing such that the head of the fastener overlaps and bears against the two wires defining the fastener slot.

15. The method of claim 14 wherein the step of fabricating a sheet of lathing material by securing a grid of vertical and horizontal wires includes spacing said wires to produce a mesh size at least one inch by one inch.

16. The method of claim 15 wherein the step of positioning and securing a plurality of auxiliary wires includes locating said wires at intervals corresponding to furring crimps in the lathing material.

17. The method of claim 16 wherein the steps of positioning of auxiliary wires and of securing lathing material includes positioning the auxiliary strands a distance slightly less than the outside diameter of a threaded fastener shank and threadedly engaging the fastener slot by means of a threaded fastener during the driving of the fasteners.

* * * * *